United States Patent [19]

Bailey et al.

[11] 4,316,647

[45] Feb. 23, 1982

[54] MINIATURE AUDIO CONNECTOR

[75] Inventors: James R. Bailey, Chicago; John R. Herron, Park Ridge, both of Ill.

[73] Assignee: Switchcraft, Inc., Chicago, Ill.

[21] Appl. No.: 99,046

[22] Filed: Nov. 30, 1979

[51] Int. Cl.[3] ..... H01R 13/629

[52] U.S. Cl. ..... 339/91 R; 339/186 R

[58] Field of Search ..... 339/14 R, 75 P, 89 C, 339/90 C, 91 R, 177 R, 177 A, 184 RM, 180 RM

[56] References Cited

U.S. PATENT DOCUMENTS

| | | | |
|---|---|---|---|
| 2,748,362 | 5/1956 | Andis | 339/75 P |
| 3,384,703 | 5/1968 | Forney et al. | 339/177 R X |
| 4,178,054 | 12/1979 | Landig | 339/177 R X |

FOREIGN PATENT DOCUMENTS

| | | | |
|---|---|---|---|
| 996 | 3/1979 | European Pat. Off. | 339/177 R |
| 2802680 | 8/1978 | Fed. Rep. of Germany | 339/91 R |
| 1355757 | 2/1964 | France | 339/91 R |
| 804474 | 11/1958 | United Kingdom | 339/91 R |

*Primary Examiner*—Eugene F. Desmond
*Attorney, Agent, or Firm*—Richard M. Sharkansky; Joseph D. Pannone

[57] ABSTRACT

An audio connector comprising the combination of a pair of detachable members, one of such members including a hollow sleeve-like conductive housing and a plurality of male conductive contact pins, the other one of such members having a post-like conductive housing and a plurality of female conductive pin receptacles adapted to mate with the male contact pins. A mechanical latching system including a unitary resilient latch having an elongated tongue-like conductive portion and a pair of conductive wing-like members offset from the elongated conductive portion is mounted on one of the pair of conductive housings. A manually actuated release means is mounted on the latch. The elongated tongue-like portion of the latch is adapted to slide within a polarization groove formed within the other one of the pair of conductive housings, such groove being cut through a lip formed on the inner periphery of the hollow sleeve-like conductive housing. The wing-like members engage the lip to lock the members together until the release means is actuated to disengage the wing-like members from the lip. The tongue-like conductive portion provides electrical continuity between the conductive housings, reduces mechanical vibrations between the pair of members, and provides a keying mechanism for the connector.

6 Claims, 12 Drawing Figures

LATCH ASS'Y.

POLARIZATION GROOVE 126

MINIATURE AUDIO CONNECTOR

BACKGROUND OF THE INVENTION

The invention relates in general to electrical connectors and, more particularly, to electrical connectors suitable for use in audio systems.

In U.S. Pat. No. 3,219,961, issued to James R. Bailey et al., Nov. 23, 1965 and assigned to the assignee of the present invention, a prior art electrical connector suitable for use in audio systems is described. Such connector includes a pair of detachable members, one member being connected to a source of sound, such as a microphone, and the other being connected, for example, to an audio amplifier. One member provides a sleeve-like receptacle for the other member. When engaged the pair of members electrically interconnect the microphone and the audio system. In order to disengage the members a mechanical release latch is provided. The mechanical latching arrangement is substantially externally exposed and comprises a rigid latch, with a separate biasing spring. The latch is provided with pivot projections at one end and at an end remote thereto, a finger piece and a detent which engages a notch in the inner walls of one of the pair of detachable members. It is, therefore, noted that this latching system requires plural components. Further, in order to ensure electrical continuity between the pair of detachable members a separate internally disposed resilient conductive element is used to bridge the members when mated. Consequently while such connector is useful in many applications when such connector is to be miniaturized in size use of plural components makes assembly difficult.

SUMMARY OF THE INVENTION

The present invention overcomes the above and other disadvantages of the prior art by the provision of an audio connector comprising the combination of a pair of detachable members, one such member being, for example, a male cord plug having a hollow sleeve-like conductive housing including a base-pin insert having a plurality of male conductive contact pins and the other member having a post-like conductive housing member being, for example, a female cord plug having a a plurality of female receptacles adapted to mate with the male contact pins, such post-like conductive housing being shaped to interfit in coaxial alignment within the hollow sleeve-like conductive housing member of the male cord plug. A mechanical latching system includes a unitary latch, having an elongated resilient tongue-like section connected to a manually acuated release button, and a pair of offset conductive wing-like members. The unitary latch is in electrical contact with the post-like conductive housing member. The male conductive housing member has a lip formed within its inner wall and a polarization groove cut through one section of such lip. The female cord plug is interfitted within the male cord with the elongated resilient tongue-like section of the latch positioned within the polarization groove to mechanically key the orientation of the connector components prior to insertion. When inserted, the tongue-like section of the latch passes through the groove, and the resilient latch causes the wing-like members to engage the lip formed within the sleeve-like conductive housing member of the male cord plug to prevent disengagement of the plugs unless the release means is actuated. The tongue-like portion of the latch engages the inner wall of the hollow conductive housing member to provide electrical continuity between the pair of conductive housing members, and reduce mechanical vibrations between the pair of plugs.

BRIEF DESCRIPTION OF THE DRAWINGS

The above-mentioned and other features of the invention will become more apparent by reference to the following detailed description taken together in conjunction with the accompanying drawings wherein like reference numerals designate like parts throughout the following described views.

DESCRIPTION OF THE PREFERRED EMBODIMENTS

Figures 1, 2, 3, 8:
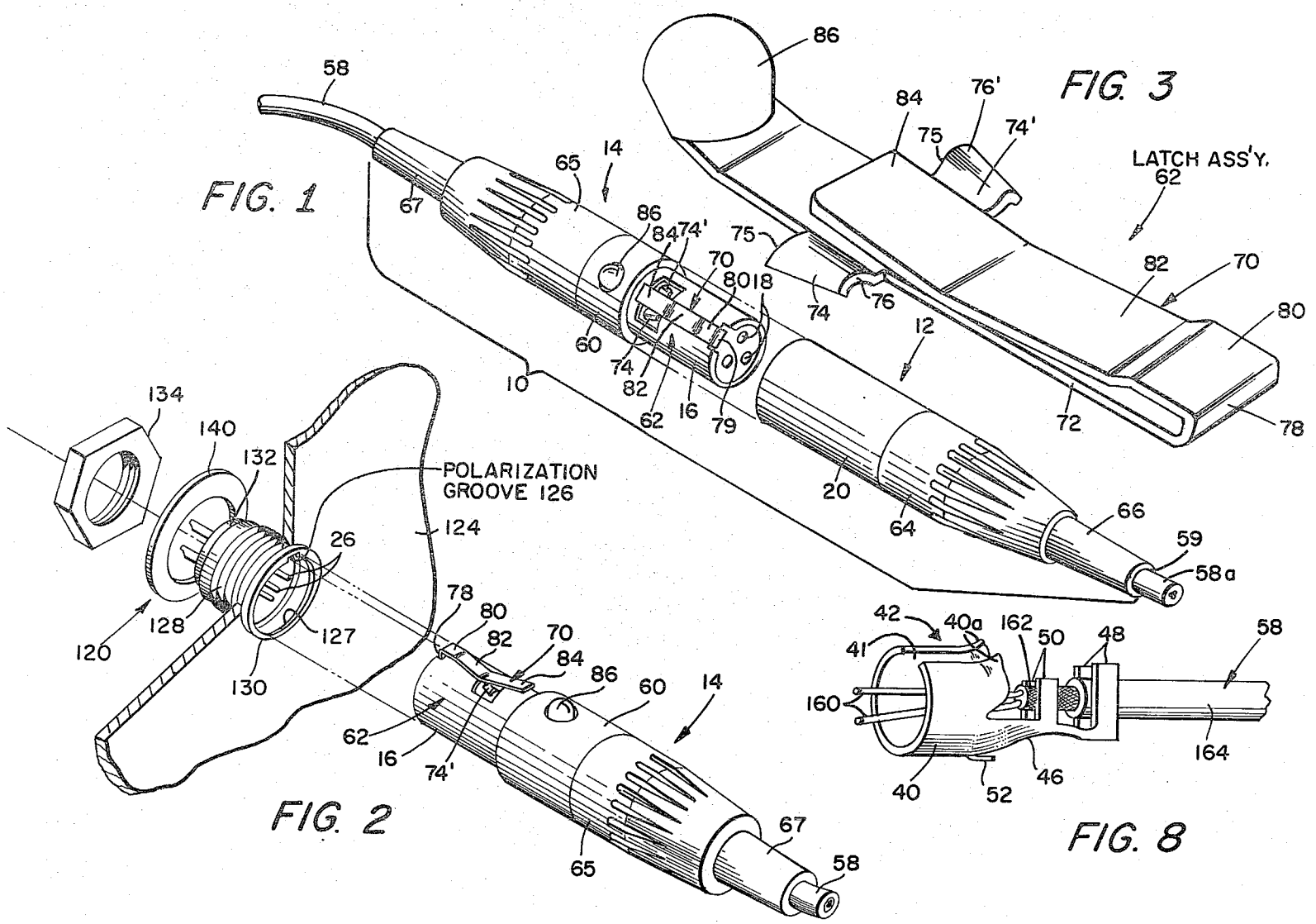
FIG. 1 is an exploded pictorial view of the male and female cord plugs of a connector according to the invention.
FIG. 2 is an exploded pictorial view of an alternative embodiment of the invention for chassis/panel mounting.
FIG. 3 is an isometric view of a latch member of the mechanical latching system of the connector shown in FIG. 1.
FIG. 8 is an isometric view of a preferred cable clamp with the cable conductor attached.
Figure 4:
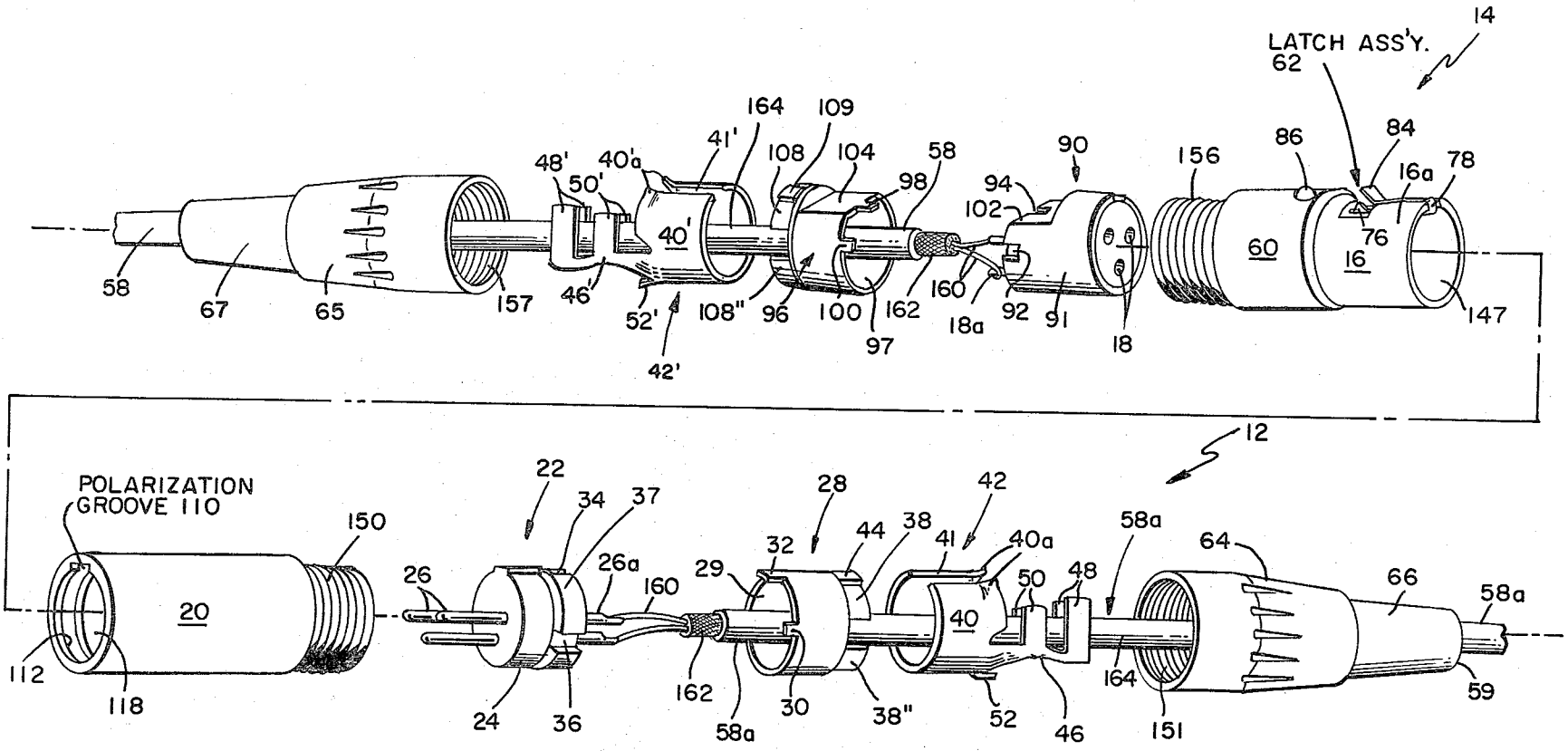
FIG. 4 is an exploded pictorial view of the components of both the male and female cord plug of the audio connector of FIG. 1.

Referring more particularly to the drawings, FIGS. 1 and 4 illustrate the principal components of a miniature audio connector 10. Such connector 10 includes the combination of a pair of detachable members 12, 14 such as, for example, male cord plug 12 and a female cord plug 14. The female cord plug 14 includes a longitudinal reduced wall hollow post-like section 16 adapted to interfit with the hollow portion of the male cord plug 12. In this way the female cord plug 14 and the male cord plug 12 have a coaxial alignment when engaged.

The male cord plug 12 comprises a hollow conductive housing 20, (also shown in detail in FIGS. 4, 5A and 5B), preferably of a copper alloy, with a bright nickel plate. The conductive housing 20 has a threaded end section 150 and, at the other end a polarization groove 110. For reasons to be described in detail herein-after such end also includes a lip 112. The internal components axially disposed within conductive housing 20 include a base-pin insert 22 having a dielectric base 24, preferably of a molded high strength thermoplastic, and a plurality of conductive male contact pins 26, preferably a silver plated copper alloy with a clear chromate coating. The pins 26 are electrically insulated from each other by the dielectric base 24 and protrude through the base 24 so as to provide terminal portions 26*a* for connection to the signal leads 160 of the cable conductor 58*a*. A ridge 37 engages a lip 146 formed within housing 20 to retain such base 24 within such housing 20 as shown more clearly in FIGS. 5A, 7A and 7B. A hollow insulating spacer 28 having an axial passageway 29 for the signal leads of the cable conductor 58*a* follows. Such spacer 28 is provided with tabs 30 and 32 to engage notches 34, 36 respectively, formed in a polarized spaced relationship about the periphery of base 24 to assure positive interlocking of the assembled components, and ease of assembly without any soldering. The opposing end of insulating spacer 28 includes three circumferentially disposed tabs, here two being visible, 38 and 38″ to frictionally engage the split semicircular portion of resilient wall 40 of a conductive cable clamp 42.

The cable clamp 42 is also shown in greater detail in FIG. 8. The three tabs (only 38, 38″ being shown) of spacer 28 (FIG. 4) engage the inner walls of the split portions of wall 40 of clamp 42 and are held to it by a press fit. In addition the insulating spacer 28 has a raised tab 44 for introduction within the slot 41 of split semicircular portions of wall 40. Cable clamp 42 further comprises rib section 46, rear ears 48, and front ears 50, with the rear ears 48 crimped to the outer cable cover 164, here of rubber or plastic of audio cable 58. The front ears 50 are crimped to the shielding braid 162, here preferably of copper as shown more clearly in FIG. 8. Plural signal leads 160, whose number is determined by the number of contact pins 26, conventionally, 3 to 5, here only two being shown, are electrically connected, here by solder to end portions 26*a* of the contact pins 26. Nib 52 in rib section 46 provides for locking of the cable clamp 42 in a slot 54 formed in the threaded end 150 of housing 20 as shown more clearly in FIGS. 5A, 7A and 7B to prevent rotation of the clamp. The interlocking component, such as spacer 28 and base-pin insert 22, are thereby mechanically interconnected and aligned. Flared wall 40*a* (FIG. 4) engages the inner walls of conductive housing 20, as shown more clearly in FIGS. 7A, 7B to electrically interconnect cable clamp 42, and hence shielding braid 162 (FIG. 8), to the conductive housing 20. In combination with lip 146 (FIG. 5) in the center of housing 20 the enclosed components are prevented from axial movement and are secured without resort to solder or similar fastening means. Cable clamp 42 is preferably fabricated of steel and has an electrotinned finish.

Male cord plug 12 includes the end cap 64 which is secured to the threaded nonmating end 150 of housing 20 by means of internal threads 151. The end cap 64 is preferably of a molded black thermoplastic elastomer. Flex relief boot 66, preferably of a non-rigid rubber material, is appended to the end of the end cap 64, as shown. Flex relief boot 66 minimizes cable 58*a* bending stress at the point of cable entry 59. The maximum recommended cable diameter is 0.115 inches when boot 66 is employed. By omitting boot 66 the male cord plug 12 may utilize cable diameters up to 0.170 inches.

Female cord plug 14 (also shown in detail in FIG. 4,) is fabricated of materials similar to companion male cord plug 12. The internal components disposed within conductive housing 60 of post-like section 16 is a plug insert 90, having a plurality of conductive female receptacles 18, formed therein, electrically insulated from each other by the dielectric insert base 91. Female receptacles terminate in end portions 18*a* which are adapted for connection to signal leads in a similar manner as leads 160 and ends 26*a* of plug 12, described above. Notches 92 and 94 are provided to mate with an insulating spacer 96 having matching tabs 98 and 100 to assure proper coaxial alignment. A flat portion 102 formed on the top of insert 90 and a flat portion 104 formed on top of dielectric spacer 96 combined to define a chamber 106 (FIGS. 7A and 7B), for reason to be described. Proper alignment is ensured by engaging tab 98 of spacer 96 with slot 94 of plug insert 90. Spacer 96 has an axial passageway 97 for passage for the the cable components 58 to be connected to the terminal ends 18*a* of the receptacles 18.

Cable clamp 42′ is similar to the previously described cable clamp 42 in male cord plug 12 and is press fit over three tabs (tabs 108 and 108″ being shown). Tab 109 of spacer 96 is fit with slot 41′ formed between walls 40′, as indicated, in a manner similar to that described in connection with cable clamp 42. Flared wall 40*a*′ engages the inner walls of conductive housing 60, in a manner similar to that described above in connection with clamp 42 and electrically interconnect cable clamp 42′, and hence the shielding braid 162 of cable 58, to conductive housing 60. Cable clamp 42′ includes similar rear ears 48′ and front ears 50′ for crimping to the cable conductor 58 for connection to the audio circuit. Nib 52′ (FIGS. 4, 7A, 7B) extends within slot 56 (FIG. 6A) in housing 60 when the cable clamp 42′ and appended interlocking components, 96 and 90 are introduced into the hollow passageway 147. End cap 65 and flex relief boot 67 enclose the nonmating end of the housing 60 with the end cap 65 engaging threaded end 156 by means of internally disposed threads 157.

Figure 6B:
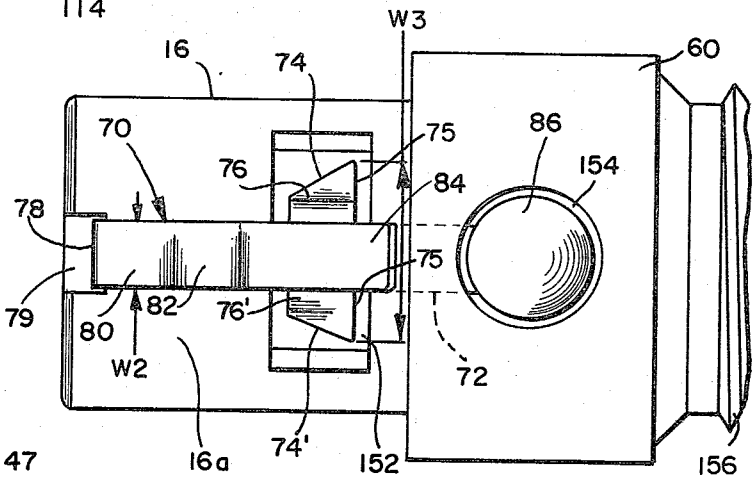
FIG. 6B is a top elevational view of the the housing shown in FIG. 6A taken along the line 6B—6B.
Figure 6A:
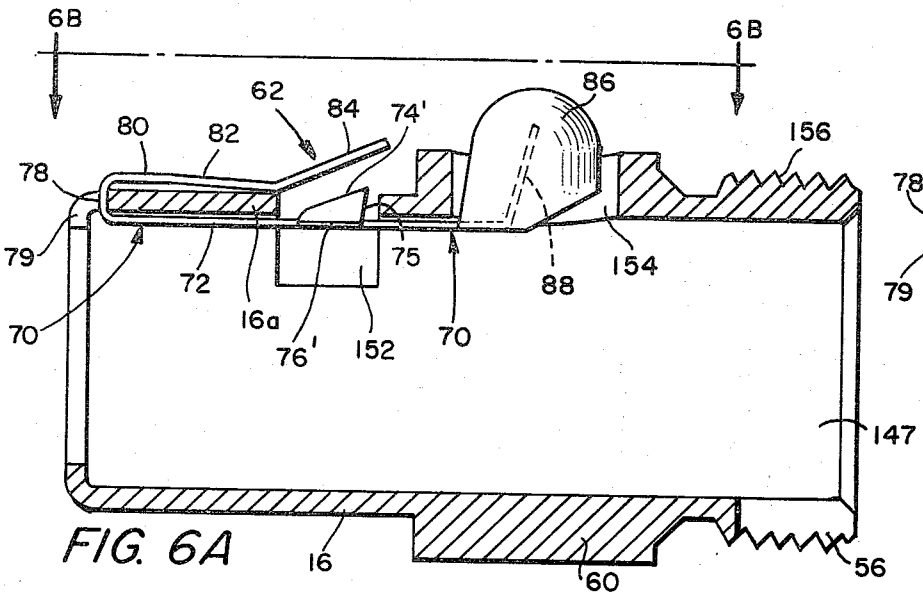
FIG. 6A is a cross-sectional view of a post-like conductive housing used in the female cord plug showing the latch of FIG. 3 mounted thereto.

Referring again to FIGS. 1, 2, 3, 4, 6A and 6B, as well as FIGS. 7A, 7B, the latch assembly 62 of the present invention will now be described. Referring first to FIGS. 3 and 6A, 6B, latch assembly 62 is a unitary U-shaped, resilient structure having an elongated tongue-like conductive portion 70 and a pair of conductive wing-like members 74, 74′ offset from the elongated conductive portion 72, as shown. The offset wing-like members 74, 74′ have raised arcuate portions 76, 76′ and larger front edges 75, 75′. The elongated portion 72 is adapted to pass through polarization groove 110 of member 20 (FIG. 4). The latch 62 includes a bight portion 78 (FIGS. 3 and 6A) disposed within notch 79 in housing wall 16*a* and is followed by a raised flattened portion 80 and the elongated resilient tongue-like portion 82 with a slightly upturned depressable end portion 84. Manually acuated release button 86 is secured to upturned portion 88 of latch 62 (FIG. 6A). Latch 62, except for button 86, is preferably fabricated of beryllium copper and is nickel plated after heat treatment. Release button 86 comprises a molded black thermoplastic material. In FIG. 7B the latch assembly 62 is illustrated with release button 86 in a depressed state so that offset wing-like members 74, 74′ are positioned within notch 152 defined in housing wall 16*a* (as shown in FIG. 6A) to provide clearance for the movement of the wing-like members 74, 74′ when straight latch section 72 is depressed, as shown, by acuation of button 86 to thereby disengage the mated components. Release button 86 extends within a circular opening 154 (FIGS. 6A, 6B) provided in the wall of housing 60. It is noted that in FIG. 7A, the button 86, when depressed, fits within the chamber 106 formed by the flat portions 102, 104 (FIG. 4).

Figure 5B:
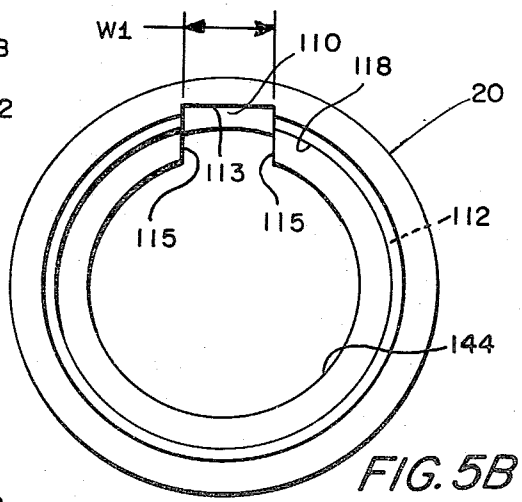
FIG. 5B is an end view of the housing shown in FIG. 5A, taken along the line 5B—5B.
Figure 5A:
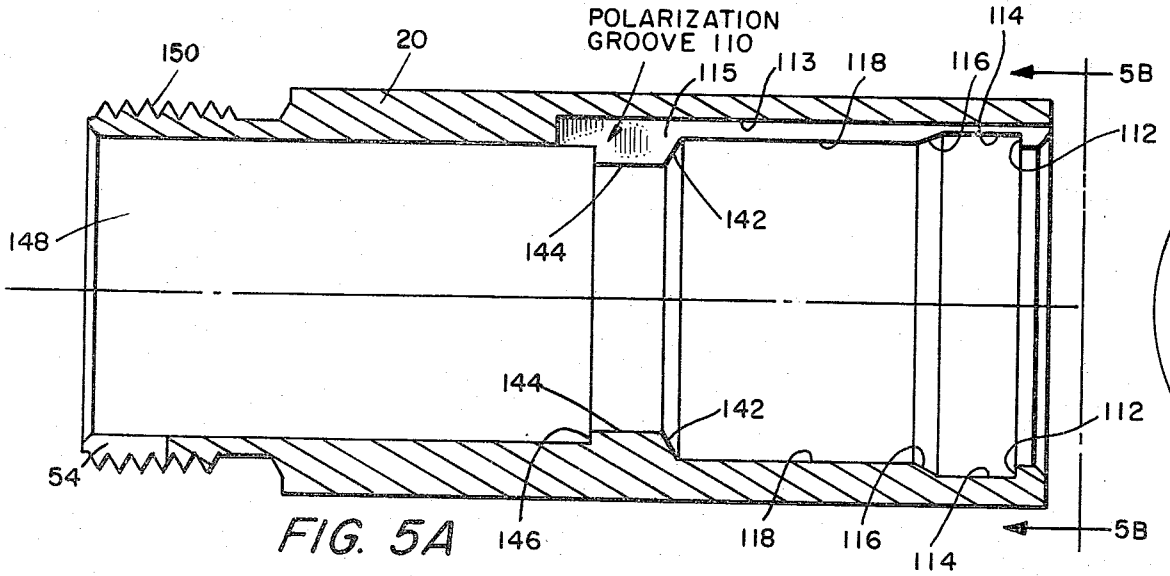
FIG. 5A is a cross-sectional view of a hollow sleeve-like conductive housing used in the male cord plug, here shown without any internal components to illustrate a polarization groove formed in such housing.
Figure 9:
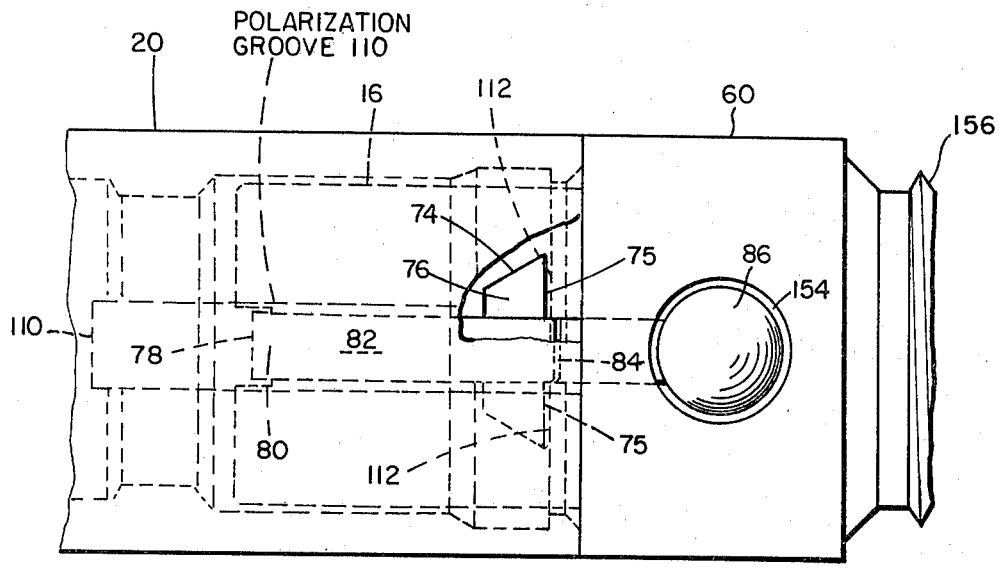
FIG. 9 is a plan view partially broken away to reveal underlying structure of the mated male and female cord plugs.

Further, in accordance of the teachings of the invention, the polarization groove 110 (shown in FIGS. 4, 5A, 5B, 7A, 7B and 9) is provided within the sleeve-like housing 20 to receive and substantially enclose latch 62. The polarization groove 110 having substantially straight upper and side walls 113, 115 (FIG. 5B) and provides a receptacle for the elongated tongue-like portion 70 of latch 62 so that it mechanically keys the latch to thereby orient the mating of the male contact pins 26 (FIG. 4) with female receptacles 18, prior to their engagement to prevent damage by bending of the male pins 26 through misalignement. Polarization groove 110 extends substantially through half the length of housing 20, as shown in FIGS. 5A, 9. Referring to FIG. 5B the width $W_1$ of the polarization groove 110 is slightly larger than the width $W_2$ of the tongue-like portion 82 of latch 62 to receive such portion 82 but the width $W_1$ of groove 110 is smaller than the width $W_3$ across the pair of wing-like members 74, 74'. Such members 74, 74', in particular edges 75, 75' of such members 74, 74' engage the lip portion 112 of housing 20 when the plugs 12, 14 are interfitted as shown in FIG. 9. In addition, the raised portion 76, 76' engage the sidewalls adjacent the groove 110, also shown in FIG. 9.

Figure 7A:
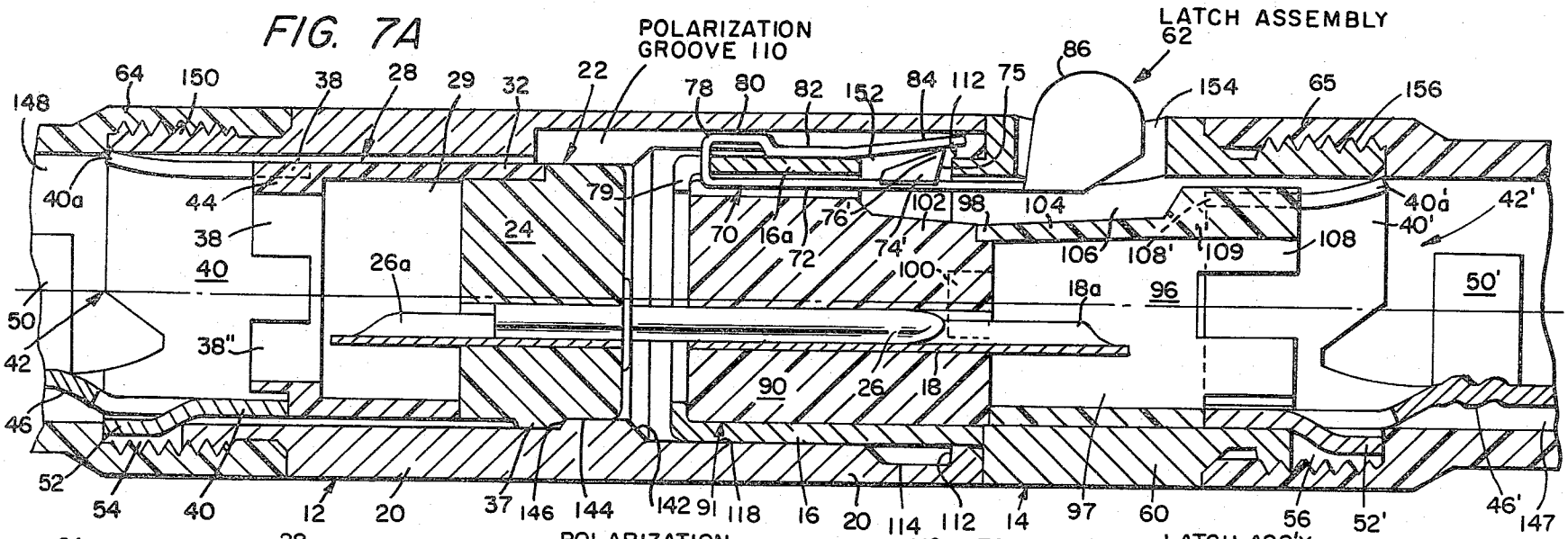
FIG. 7A is a cross-sectional view of the interfitted male and female cord plugs in the engaged or intermated position, together with internal structure also shown in cross section.
Figure 7B:
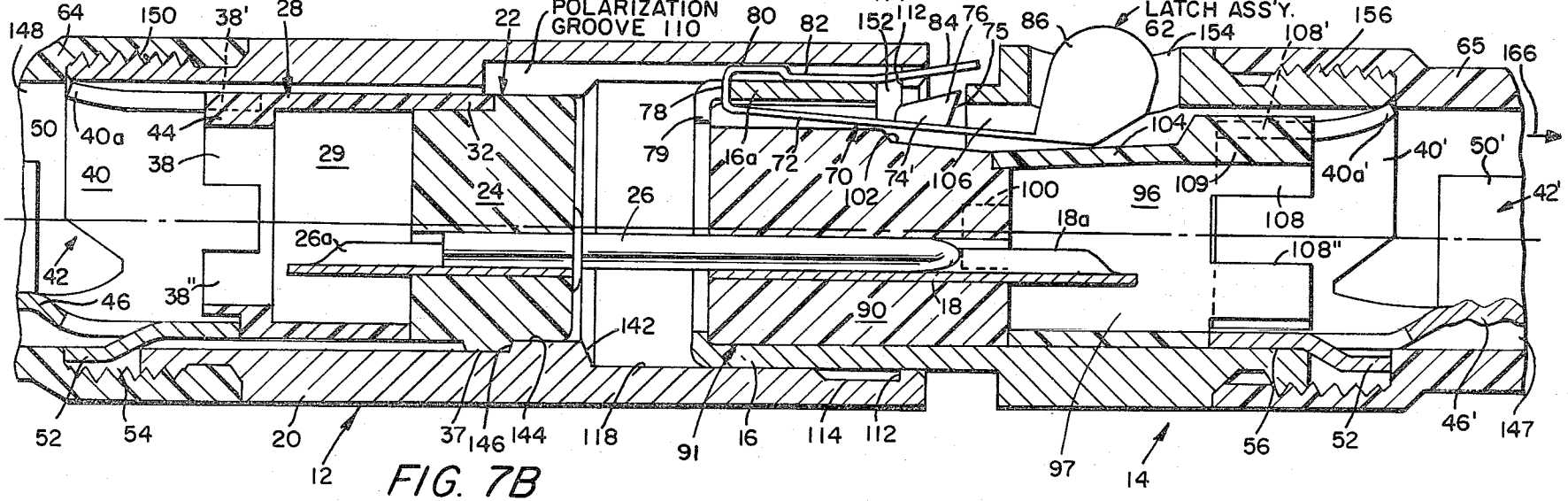
FIG. 7B is a view similar to FIG. 7A showing the male and female cord plugs, partially detached with the latch release button of the latch assembly depressed.

Turning now to FIGS. 4, 5A, 5B, 7A, 7B and 9, the lip 112 adjacent the entrance to the hollow passageway in housing 20, provides for the positive latching of the interfitted housings 16, 20. The lip 112 is contacted by the front edge 75, 75' of the offset wing-like members 74 and 74' after insertion of the latch 62 within the polarization groove 110. The combination of mechanical forces evolving with the compression of latch end 84 by contact with the upper straight wall 113 forming polarization groove 110 and the compression of the wing-like arcuate portions 76, 76' by the housing walls adjacent to the groove 110 provide for the vibration-resistant anti-rattle characteristics of the mated members of the overall connector. The disposition of the wing-like members front edge 75, 75' against lip 112 when the cord plugs are mated, as shown in FIGS. 7A, 9 in addition to providing for positive latching, contributes to another feature of the invention, namely, minimum axial play to thereby assure positive interconnection of the housings and contact pins within the receptacles for high integrity circuit continuity in an audio system. It is noted in FIG. 7A that end portion 84 of latch 62 is under compression and contact upper straight grooved wall 113 in conductive member 20. Likewise elongated portion 72 is forced against conductive housing portion 16*a* of conductive housing 16. In this way latch 62 ensures circuit continuity between conductive housings 16 and 20.

Recessed wall section 114 (FIG. 5A) forms lip portion 112 and engages the offset wing-like members 74, 74' when the male and female cord plugs are interconnected as shown in FIGS. 7A, 9. Champfered section 116 (FIG. 5A) provides for a transition to a following reduced wall section 118 to engage the interfitting wall post-like member 16 of housing 60, when the respective cord plugs 12, 14 are interfitted. Champfered transition wall 142 leads to reduced cylindrical wall portion 144 which terminates axial travel of the internal connector components disposed within passageway 148 by means of engagement of lip 146 with ridge 37 of base 24, as shown in FIGS. 7A and 7B.

FIG. 7A illustrates the details of the connector subassemblies when interfitted with the longer edge 75' of offset wing-like members 74, 74' (only member 74' being shown) contacting lip portion 112 of housing 20 and wall portions adjacent the groove 110. The upturned latch end 84 does not contact lip 112 and is compressed by engagement with abutting upper straight wall 113 of polarization groove 110. The disclosed arrangement assures positive interlatching and vibration-resistant anti-rattle mating as well as circuit continuity between conductive members 20 and 60.

In FIG. 7B, release button 86 has been depressed thereby disengaging the longer edge 75 of offset wing-like members 74, 74' from engagement with lip 112. The female cord plug 14 may then be withdrawn with wing-like member 74, 74' passing beneath lip 112 in the direction indicated by arrow 166, to break the audio circuit.

An alternative embodiment of the invention is disclosed in FIG. 2, specifically, stationary male cord receptacle 120 and movable female cord plug 14, similar to the one shown in FIG. 1 and 4. Receptacle 120 includes a threaded conductive housing 128 with a polarization groove 126, equivalent to groove 110 (FIG. 4) for mechanically keying to latch 70 and a lip 127 for engagement with wings 74, 74' (only 74' being shown). The receptacle is mounted on a panel, chassis or printed circuit board 124. Housing 128 has a beveled flange 130 for engaging the face of board 124. After insertion of the base-pin 26 insert in housing 128, the end is staked as 132, to prevent axial movement. Hex nut 134 threadably engages the outer walls of housing 128 with an intermediate flat washer 140 abutting the rear walls of the mounting means 124. Chassis/panel mounting utilizing the receptacle housing 128 involves the disposition of the flange 130 against the walls of the panel or chassis and tightening the hex nut 134.

From the foregoing it will be apparent that in accordance with this invention there has been provided a novel miniature audio connector with a unitary latch which facilitates fabrication, ensures circuit continuity, provides positive latching and reduces mechanical vibration. It is to be understood, of course, that although the polarization groove and latch assembly have been shown and described herein as being disposed in the male and female housings, respectively with the male housing including the contact pins and polarization groove and the female housing accomodating the latch assembly, such components may be reversed, if desired and disposed in opposite housings from those disclosed herein.

It will also be apparent from the foregoing that various modifications and changes in the preferred embodiments, shown and described, may be made, and that such changes may be made by those skilled in the art without departing from the spirit of the invention as expressed in the accompanying claims. Therefore, all matter shown and described is to be interpreted in an illustrative rather than in a limiting sense.

What is claimed is:

1. An electrical connector comprising:

(a) a first connector member comprising a sleeve-like housing having at least one electrical conductor, the housing having a lip and a polarization groove, the lip being disposed laterally adjacent the groove;

(b) a second connector member comprising a post-like housing having at least one electrical conductor and having a longitudinal portion to interfit in coaxial alignment with the sleeve-like housing of said first connector member; and (c) a mechanical latching system carried by said longitudinal portion of the post-like housing including a resilient latch member having a wing-like projection extending laterally outward from an edge portion of said latch member, (d) said latch member being adapted to be slidably disposed within said polarization groove when said second member is mated with said first member, with said wing-like projection engaging the lip of the sleeve-like housing to interlock the first and second connector members.

2. An electrical connector comprising:

(a) a first connector member comprising a sleeve-like housing having at least one electrical conductor; such housing having a lip and a polarization groove passing through a portion of the groove;

(b) a second connector member comprising a post-like housing having at least one electrical conductor and having a longitudinal portion to interfit in coaxial alignment with the sleeve-like housing of said first connector member;

(c) a mechanical latching system carried by said longitudinal portion of the post-like housing including a unitary elongated resilient tongue-like latch member with offset wing-like members;

(d) said elongated tongue-like member being adapted to be slidably disposed within said polarization groove when said second connector member is mated with said first member, the wing-like members engaging the lip of the sleeve-like housing to interlock said first and second connector members; and, (e) said unitary member is substantially U-shaped with a substantially flattened section adjacent a bight portion of the U-shaped member followed by an upturned section, said upturned section being adapted to slidably engage and be compressed by an upper wall forming said polarization groove; said flattened section being adapted to mechanically key the introduction of said second member when said first and second connector members are interfitted.

3. An electrical connector according to claim 1 wherein said wing-like projection has a raised arcuate shaped section adapted to slidably engage and be compressed by an inner wall of said sleeve-like housing adjacent to walls forming said polarization groove when said latch member is mechanically keyed within said polarization groove.

4. An audio connector comprising:

(a) a first connector member comprising a hollow sleeve-like housing having at least one electrical conductor and having a lip portion and a polarization groove passing through a portion of the lip;

(b) a second connector member comprising a post-like housing having at least one electrical conductor and having a longitudinal portion to interfit in coaxial alignment with the hollow sleeve-like housing of said first connector member;

(c) a mechanical latching system carried by said second connector member including a unitary resilient tongue-like latch member with offset wing-like members; said latch member being slidably disposable within said polarization groove with said wing-like members engaging said lip of the sleeve-like housing to interlock the first and second connector members;

(d) a pair of cables, each one having an electrical lead and a shielding braid adapted to enter a nonmating end of one of said connector members;

(e) cable attachment means disposed within said first and second connector members adjacent to a point of cable entry;

(f) said cable attachment means comprising split wall portions with flared end walls, an ear portion, and projecting nib portions;

(g) said ear portion being adapted to be connected to said shielding braid of said cable;

(h) said electrical leads being connected to said electrical conductors;

(i) said flared end walls being adapted to engage and be press fitted in electrical contact with an inner wall of said housings; and (j) said projecting-nib portions being adapted to be positioned within a notch provided in an end of said housings.

5. An audio connector comprising:

(a) a first connector member comprising a hollow sleeve-like housing having at least one electrical conductor and wall structure having a lip portion and an elongated polarization groove passing through the lip;

(b) a second connector member comprising a post-like housing having at least one electrical conductor and having a longitudinal portion to interfit in coaxial alignment with the hollow sleeve-like housing of said first connector member; and (c) a mechanical latching system carried by said longitudinal portion of the post-like housing including a unitary elongated resilient tongue-like latch member with offset wing-like members;

(d) said latch member being slidably disposable within said polarization groove with said wing-like members engaging the lip of the sleeve-like housing to interlock the first and second connector members;

(e) the width of said polarization groove being slightly larger than the width of the elongated tongue-like latch member to receive such latch member within the groove when said second connector member is engaged with said first member; and (f) the width of said polarization groove being smaller than the distance across said offset wing-like members, the latter such wing-like members engaging an inner wall of such housing adjacent to the polarization groove when said second connector member is engaged with said first connector member.

6. An electrical connector as set forth in claim 3 wherein said sleeve-like housing of said first connector member and said post-like housing of said second connector member are electrically conductive and electrically connected to one another through said tongue-like member and said wing-like projection of said latching system.

* * * * *